US005337640A

United States Patent [19]

Arnoth et al.

[11] Patent Number: 5,337,640

[45] Date of Patent: Aug. 16, 1994

[54] CUTTER BLADE ASSEMBLY

[75] Inventors: Frank W. Arnoth, Glen Mills, Pa.; William C. Hoffman, Jr., Wilmington, Del.

[73] Assignee: Freeshworld, Inc., Cinnaminson, N.J.

[21] Appl. No.: 999,704

[22] Filed: Dec. 31, 1992

[51] Int. Cl.[5] ..... B26D 1/02

[52] U.S. Cl. ..... 83/444; 83/105; 83/449; 83/446; 83/857; 83/858; 99/537; 99/545; 99/543

[58] Field of Search ..... 83/105, 449, 440, 441, 83/444, 446, 856, 857, 858, 437, 404.1, 404.3; 99/537, 545, 543; 30/113.1, 123.5

[56] References Cited

U.S. PATENT DOCUMENTS

| | | | |
|---|---|---|---|
| 2,572,770 | 10/1951 | Shadduck | 83/437 |
| 4,372,184 | 2/1983 | Fisher et al. | 99/545 |
| 4,670,275 | 6/1987 | Orr et al. | 426/270 |
| 4,808,420 | 2/1989 | Springler et al. | 426/106 |
| 4,855,153 | 8/1989 | Orr et al. | 426/270 |
| 4,911,045 | 3/1990 | Mendenhall | 83/98 |
| 4,919,948 | 4/1990 | Orr et al. | 426/106 |
| 5,009,141 | 4/1991 | Julian et al. | 83/857 |
| 5,101,718 | 4/1992 | Lin | 83/857 |

FOREIGN PATENT DOCUMENTS

| | | | |
|---|---|---|---|
| 2751974 | 5/1979 | Fed. Rep. of Germany | 99/545 |
| 398939 | 9/1933 | United Kingdom . | |

*Primary Examiner*—Eugenia Jones
*Assistant Examiner*—Allan M. Schrock
*Attorney, Agent, or Firm*—Jane E. Obee; Clinton H. Neagley

[57] ABSTRACT

A cutter blade assembly for cutting a product, such as a carrot, into a plurality of finished end products, such as carrot sticks, comprises a blade holder and a first and second blade group disposed within the blade holder. The blade holder has a longitudinal passage formed therein. The first blade group comprises a plurality of first blades radially disposed about the longitudinal passage for cutting a first group of finished end products from the product as the product is advanced through the longitudinal passage. The second blade group comprises a plurality of second blades radially disposed about the longitudinal passage and angularly displaced with respect to the first blades. The second blades cut a second group of finished end products from the product as the product is further advanced through the longitudinal passage. Since both the first and second blades produce finished end products, the utilization of the product is maximized, and the amount of waste generated from the product is minimized.

19 Claims, 15 Drawing Sheets

CUTTER BLADE ASSEMBLY

BACKGROUND OF THE INVENTION

1. Field of the Invention

The present invention relates to a cutter blade assembly, and in particular, a cutter blade assembly for the efficient production of carrot sticks.

2. Description of the Related Art

Many vegetables and fruits are processed and preserved prior to sale to extend their useable shelf life. Most are cut into smaller edible sizes and shapes during processing, and many are cut into small cross-sectional shapes to minimize cooking time. It is well known that vegetables in particular lose some of their nutritional value when processed, stored and cooked prior to consumption. Accordingly, many vegetables are harvested, washed, packaged and quickly shipped to market to be sold fresh. It is desirable that a minimum of processing be done without adversely affecting the shelf-life of the product. Cutting of the vegetable into edible sized portions is then performed by the consumer just prior to consumption.

Root crops such as carrots and potatoes are typically cut into stick form, using a rectilinear array of strip knives, or blades, to form sticks of rectangular or square cross section. The outer crescent-shaped portions of the carrot or potato which are smaller than the minimum acceptable size are then discarded or used for other purposes, such as making juices or soups.

Methods of making staged cuts of vegetables to more efficiently utilize the vegetable are known. For example, U.S. Pat. No. 4,372,184 discloses a cutting assembly for making successive, or staged, cuts to a potato to cut two different shapes of potato products. In this assembly, a first core knife cuts a plurality of outer strips from the potato, leaving a cylindrical core and a second set of strip knives cuts the cylindrical core into pieces of substantially constant cross-section. However, this patent does not disclose successively cutting substantially identically-shaped finished end products from a vegetable.

Recent advances in the processing of fresh carrots, typified by U.S. Pat. Nos. 4,919,948, 4,855,153, 4,670,275 and 4,808,420, have extended the shelf life of carrots and made possible the factory processing of carrot sticks, which may then be shipped fresh to the retail market. These patents describe methods of prolonging the shelf-life of root crops by a mild heat treatment to reduce microflora, rapid cooling and alternate methods to prevent microbial recontamination and maintain the root crop in a viable condition. Carrot sticks processed in the manner disclosed in these patents have been successfully marketed in restaurants. To be commercially successful, carrot sticks must meet commercial requirements for size, taste, texture and shelf-life.

A carrot has a fleshy, outer portion and a more fibrous inner core portion. Carrot sticks comprised entirely of the inner core portion are commercially undesirable because the fibrous inner core tends to have less flavor and to be tougher and more difficult to chew. However, carrot sticks which are comprised of at least about half fleshy, outer portion and at most about half inner core portion are acceptable in taste and texture. Carrots grow to different diameters and contain different percentages of inner core, depending upon growing conditions, such as soil nutrients, temperature, amount of sunshine and amount of rainfall or irrigation.

Cutting a vegetable which has a round cross-section, such as a carrot, into rectangular cross-section portions with conventional rectilinear blade arrays is inherently inefficient in yield. Some carrot sticks of unacceptably small cross-section are produced. Carrot sticks of acceptable cross-section at their larger end may taper to a point or a thin triangular cross-section at their smaller end. Such carrot sticks are commercially unacceptable because their thin cross-section causes them to dry out and thus shortens their shelf-life. Additionally, properly sized, but commercially unacceptable carrot sticks comprised of all or mostly inner core may be produced. The sticks predominantly comprised of core must then be separated from the acceptable sticks. Although proper positioning of the carrot relative to the rectilinear blade array can reduce the percentage of unacceptable carrot sticks produced, a better, more efficient method of producing carrot sticks is needed.

SUMMARY OF THE INVENTION

Accordingly, the present invention solves the problems of the prior art by providing a cutter blade assembly which maximizes utilization of the core portion of a carrot.

The present invention further solves the problems of the prior art by providing a cutter blade assembly which maximizes the number of carrot sticks which can be produced from a carrot, which meet commercial requirements for size, taste, texture and shelf-life, and which minimizes waste.

Statistical profiles of percentage of core as a function of carrot diameter and growing conditions can be measured. A given crop of carrots may be statistically sampled and then characterized as to percentage of core versus overall carrot diameter. The present invention provides a cutter blade assembly which, given a set of cutting patterns for a given set of crops, produces a nearly optimum yield of commercially acceptable carrot sticks for different ranges of carrot cylinder diameter and percentage of core.

It is intended that the cutter blade assembly of the present invention may be used with other food products, and indeed may be used for cutting any product into a plurality of finished end products.

To achieve the foregoing solutions, and in accordance with the purposes of the invention as embodied and broadly described herein, there is provided a cutter blade assembly for cutting a product into a plurality of finished end products. The cutter blade assembly comprises an elongated blade holder having a longitudinal passage formed therein. The assembly also comprises a first blade group comprising a plurality of first blades radially disposed about the blade holder. The first blades cut a first group of finished end products from the product as the product is advanced through the longitudinal passage. The assembly also comprises a second blade group comprising a plurality of second blades radially disposed about the blade holder and angularly displaced with respect to the first blades. The second blades cut a second group of finished end products from the product as the product is further advanced through the longitudinal passage.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred embodiments given below, serve to explain the principles of the invention.

DETAILED DESCRIPTION OF THE PREFERRED EMBODIMENTS

Reference will now be made in detail to the present preferred embodiments of the invention as illustrated in the accompanying drawings.

In accordance with a first embodiment of the present invention, there is provided a cutter blade assembly for cutting a product into a plurality of finished end products. In the preferred embodiment, the product is a carrot. However, the present invention may also be used to cut other food products, such as, for example, pineapples, turnips, corn, cheese, etc. The cutter blade assembly of the present invention is particularly useful for products that have a core which is undesirable as part of the end product; root vegetables all have such a core. In addition, the cutter blade assembly of the present invention may be used to cut other products, such as balsa wood. A cutter blade assembly is shown generally at 10 in FIG. 1. Cutter blade assembly 10 may be used with either a hydraulically, pneumatically or mechanically activated cutting system for processing products. A product in its whole, uncut form is shown at 12, and a core is shown at **12*a* in FIG. 4. When the product is a carrot, a cylinder is created by trimming the top and root from the carrot and then cutting the ends of the remaining, tapered cylinder into portions of appropriate length. For simplicity of illustration, the product is shown in its generic form, without taper in FIG. 4**.

The cutter blade assembly of the present invention comprises an elongated blade holder 14. Blade holder 14 has a longitudinal passage 16 formed therein as shown in FIGS. 1–3, 5, 7 and 8.

Figure 3:
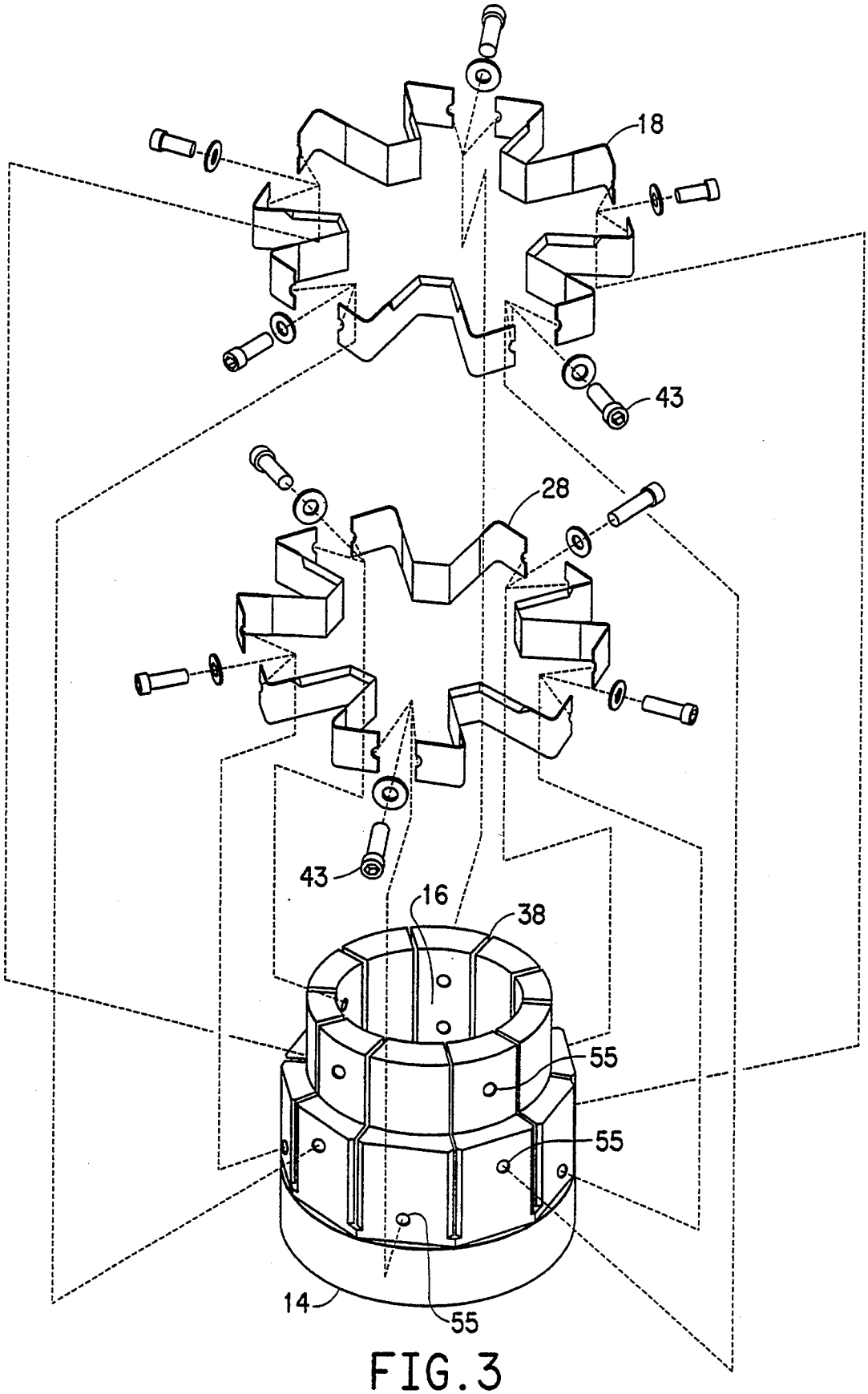
FIG. 3 is an exploded, perspective view of the cutter blade assembly of FIG. 1.
Figure 4:
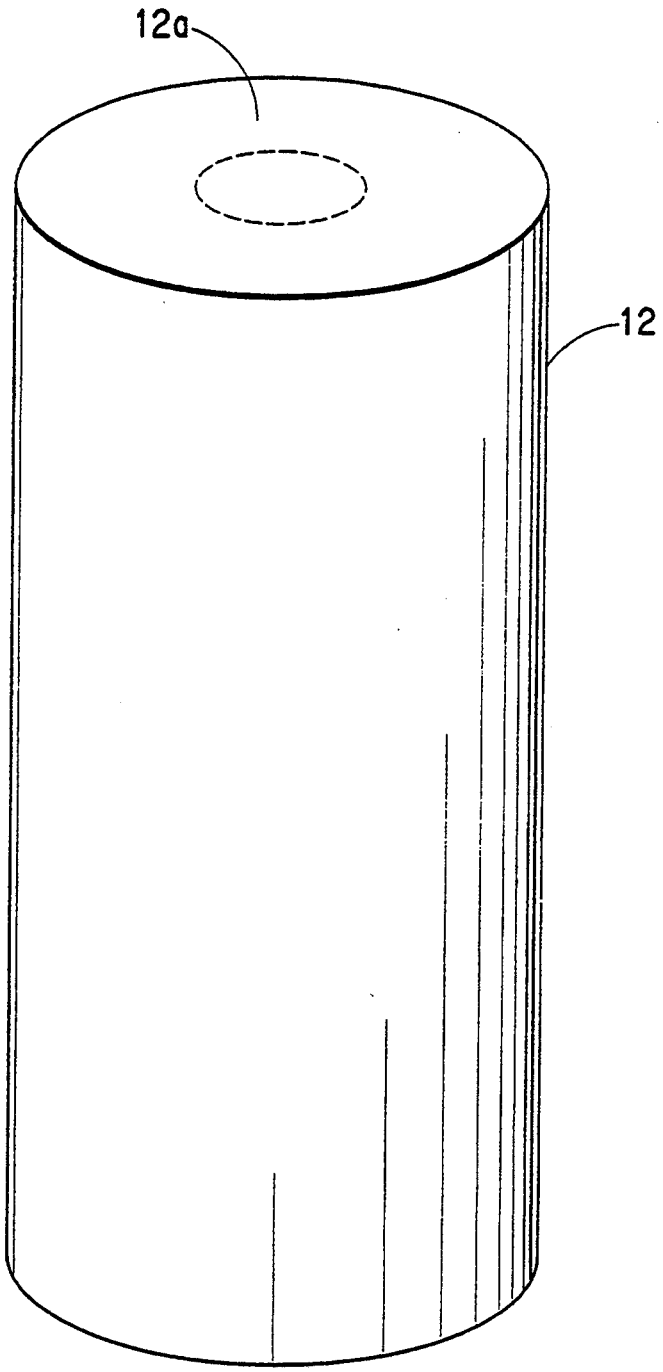
FIG. 4 is an isometric view of a product, such as a carrot cylinder, which is to be cut into a plurality of finished end products, such as carrot sticks.
Figure 5:
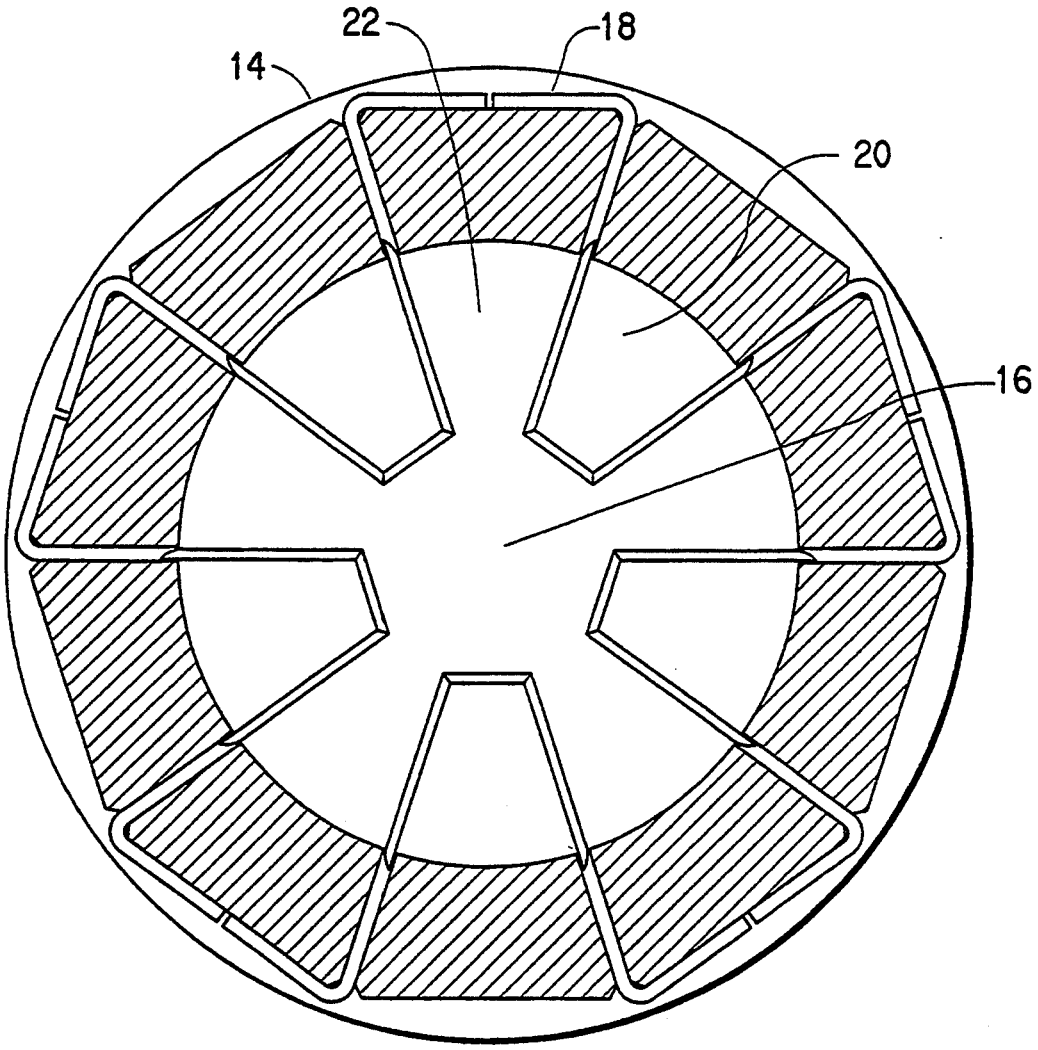
FIG. 5 is a cross-sectional, plan view, taken across lines 5—5 of FIG. 2, showing a first blade group of the cutter blade assembly of the present invention.
Figure 6:
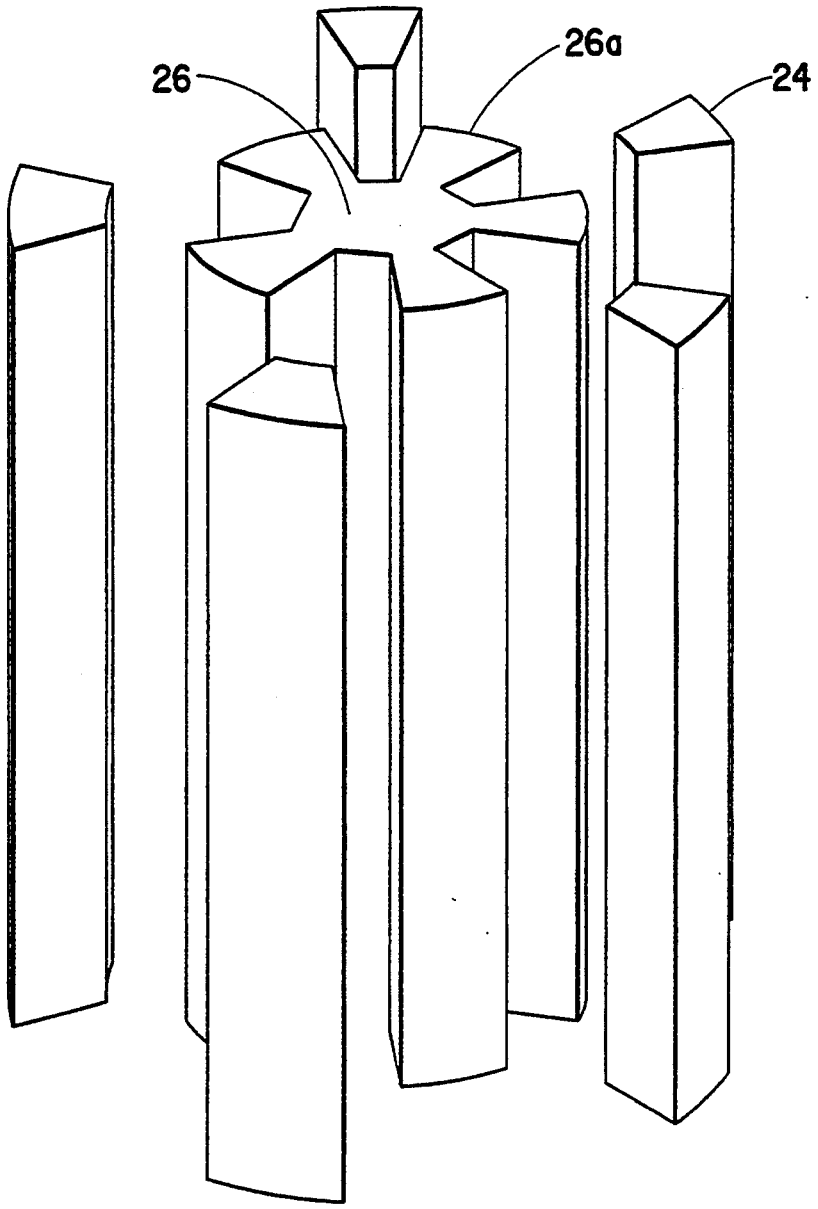
FIG. 6 is an isometric view of a partially-cut product, such as a carrot cylinder, after passing through the first blade group.
Figure 9:
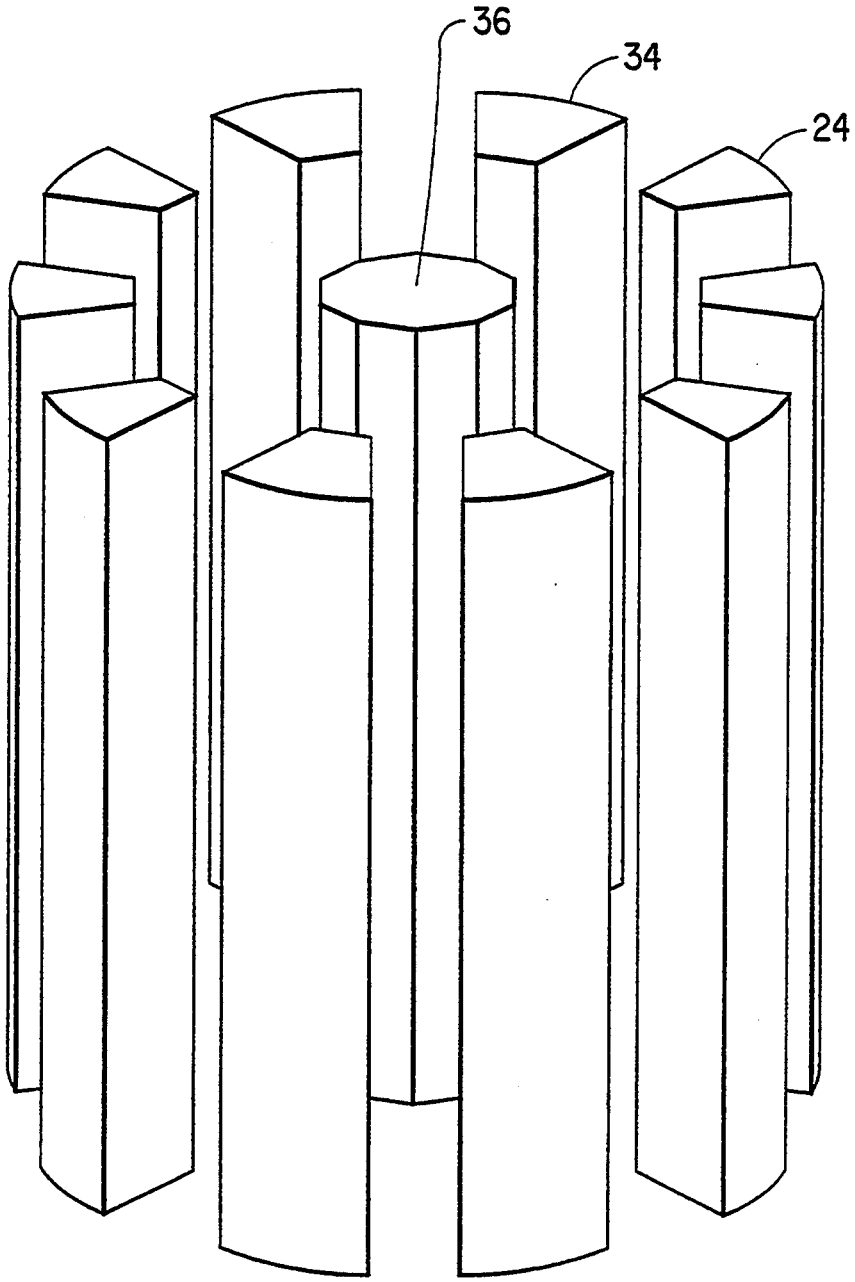
FIG. 9 is an isometric view of a cut product, such as a carrot cylinder, after passing through the second blade group.

The cutter blade assembly of the present invention also comprises a first blade group. The first blade group includes a plurality of first blades 18 as shown in FIGS. 3 and 5 which are radially disposed about the blade holder. For simplicity of illustration, only one part of the members of the present invention comprising a plurality of like elements, e.g., the blades, is labeled with a reference numeral in the Figures, it being understood that the description applies to all like elements of each member shown. As shown in FIG. 5, first blades 18 and longitudinal passage 16 form a plurality of first peripheral segments 20. A first space 22 is formed between each respective adjacent first peripheral segment 20. The first blades cut a first group of finished end products, shown at 24, respectively, as shown in FIGS. 6 and 9 from product 12 as the product is advanced through longitudinal passage 16. Preferably, the product has a generally cylindrical shape, as shown in FIG. 4, so that first blades 18 cut a plurality of radially spaced, alternating portions from the periphery of the generally cylindrically shaped product to form the first group of finished end products 24 and a central portion 26 as shown in FIG. 6. Central portion 26 comprises a plurality of splines **26*a***.

Figure 7:
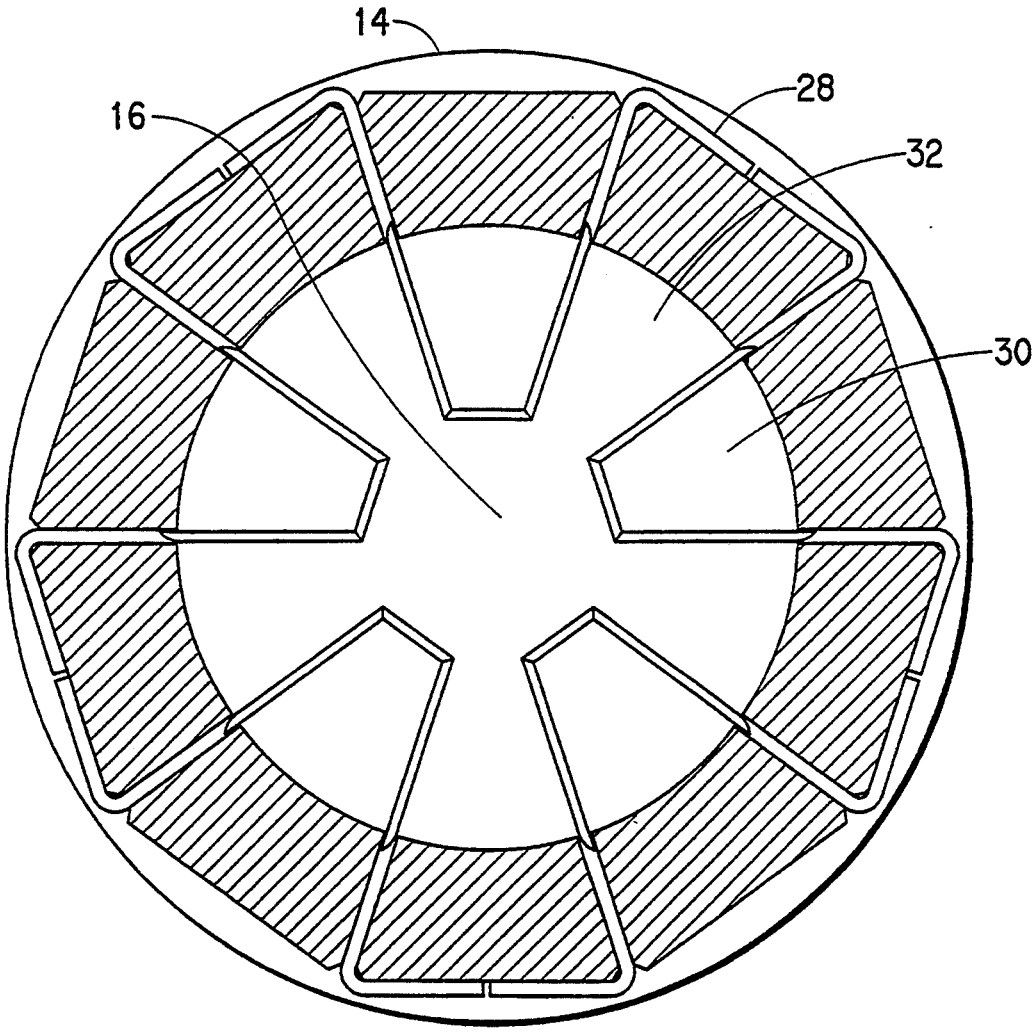
FIG. 7 is a cross-sectional, plan view, taken across lines 7—7 of FIG. 2, showing a second blade group of the cutter blade assembly of the present invention.
Figure 8:
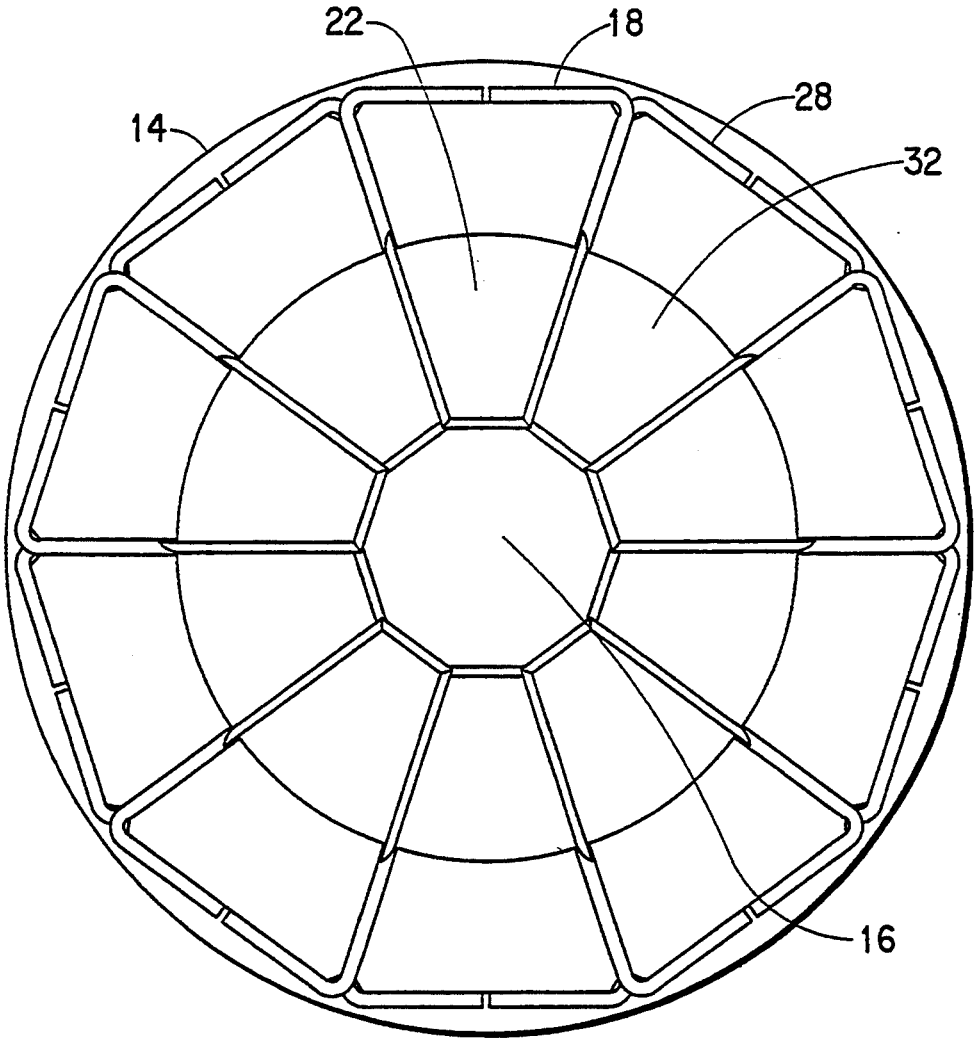
FIG. 8 is a top plan view of the cutter blade assembly of the present invention, showing both the first and the second blade groups.

The cutter blade assembly of the present invention also comprises a second blade group. As shown in particular in FIG. 7, the second blade group includes a plurality of second blades 28 which are radially disposed about the blade holder. As can be seen from FIGS. 3 and 8, second blades 28 are angularly displaced with respect to first blades 18. Second blades 28 and longitudinal passage 16 form a plurality of second peripheral segments 30 as shown in FIG. 7. A second space 32 is formed between each respective adjacent second peripheral segment 30. As can be seen from FIG. 8, each first space 22 is aligned with a second peripheral segment and each first peripheral segment is aligned with a respective second space. Thus, the first blades are interleaved with the second blades, and the first peripheral segments are interleaved with the second peripheral segments. As can be seen from FIGS. 5 and 7, each of the first and second peripheral segments have a cross-sectional area which has a shape which may be described in mathematical terms as "a sector of an annulus". An annulus is defined by two concentric circles or by two concentric polygons or a circle concentric with a polygon. The peripheral segments within each of the first and second blade groups are substantially identical to each other.

The second blades cut a second group of finished end products 34 as shown in FIG. 9 from product 12 as the product is further advanced through longitudinal passage 16. Specifically, second blades 28 subsequently cut splines 26*a* from central portion 26 to form the second group of end products 34, leaving a prism-shaped central portion 36 as shown in FIG. 9. By prism-shaped, it is meant a generally cylindrical portion of the original product that has a cross-sectional shape of a regular polygon. Each finished end product 24 of the first group and 34 of the second group, respectively, has a cross-sectional area having a shape of a sector of an annulus as shown in FIGS. 6 and 9 for products 24 and FIG. 9 for products 34.

Although, for clarity of illustration, FIG. 6 shows the first group of finished end products completely removed from the original product, when the second blades begin to make their cut, the product is still engaged with the first blades. The first group of finished end products is still only partially cut when the product engages the second blades to begin cutting the second group of finished end products. Thus, the first blade group also acts as a further alignment guide to ensure that the product is precisely aligned as it engages the second blade group.

Figure 2:
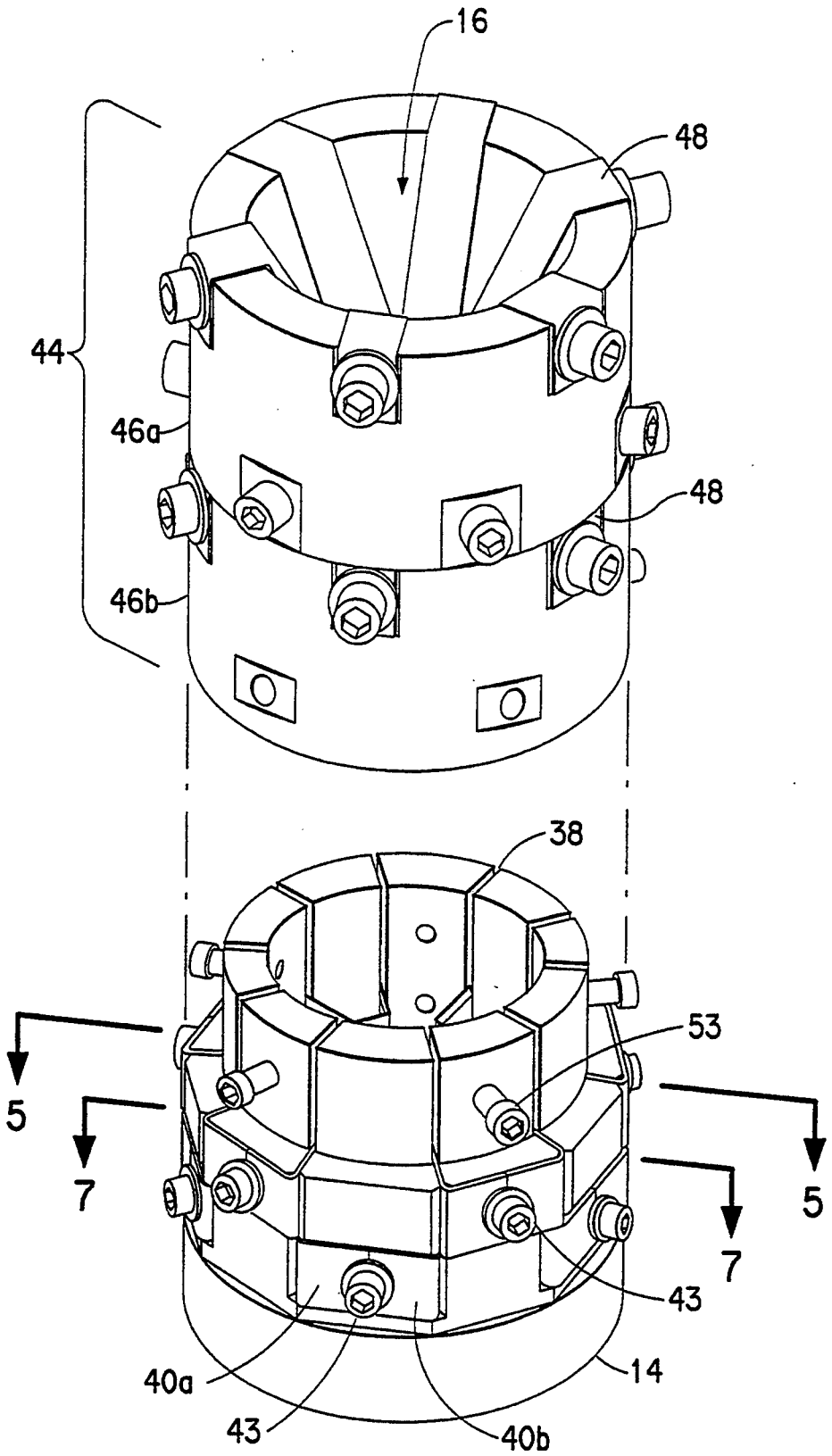
FIG. 2 is a perspective view of the cutter blade assembly of FIG. 1, disassembled to better show the alignment of the centering device and the blade groups.

The cutter blade assembly of the present invention further comprises a plurality of mounting slots 38 as shown in FIGS. 2 and 3 for mounting the blades in the blade holder. The mounting slots are formed in the inner peripheral wall of the blade holder and extend all the way through the peripheral wall of the housing as shown in FIGS. 2 and 3. The mounting slots are common to both the first and second blades. The number of common mounting slots is an even integer equal to at least four, so that the first and second blades are interleaved. Each of the first and second blades may be adapted to be inverted in a respective common mounting slot by being sharpened on both their respective longitudinal ends. With this feature, their useful life between sharpenings is extended. Also, each of the first and second blades are completely interchangeable with each other, which greatly reduces the tooling cost associated with fabrication of the blades.

Figure 10:
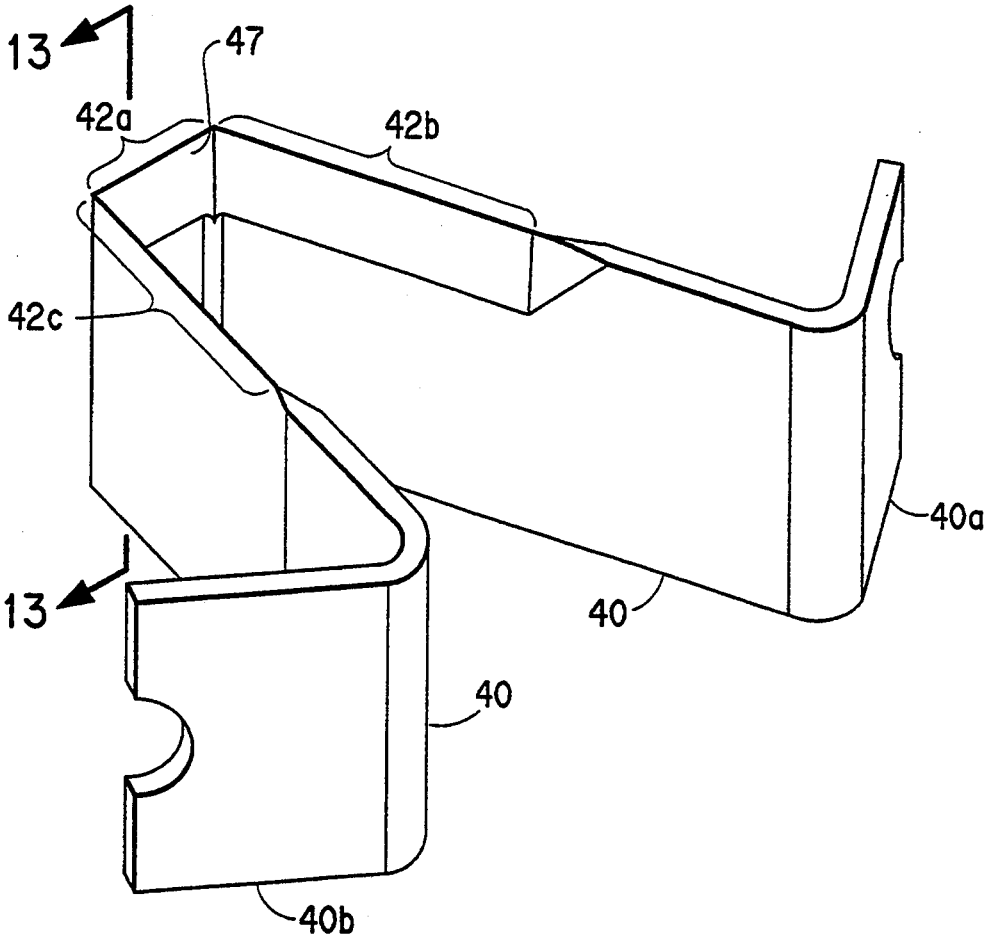
FIG. 10 is a perspective view of a blade of the cutter blade assembly of the present invention.

FIG. 10 is a perspective view of a blade according to the present invention. The blade in FIG. 10 may be either a first blade from the first blade group, or a second blade from the second blade group. In the preferred embodiment, each blade comprises a strip knife having the shape of a truncated letter "V" with a flat bottom. As may be apparent to one skilled in the cutting art, for products in which the core may be utilized in the finished end product and which have relatively small diameters, the shape of the blades for cutting the core may differ from the above description. For instance, the blades may be in the shape of an untruncated letter "V".

The blades of the cutter blade assembly of the present invention are formed by bending a strip of suitable material, such as type 316 stainless steel or type PH 18-8 stainless steel, to the desired shape as shown in FIG. 10. The flat strip is bent into the desired shape using forming dies mounted in a hydraulic press. The blades, particularly if made of PH 18-8 stainless steel, may then be heat-treated in their final form to increase their strength.

Figure 11:
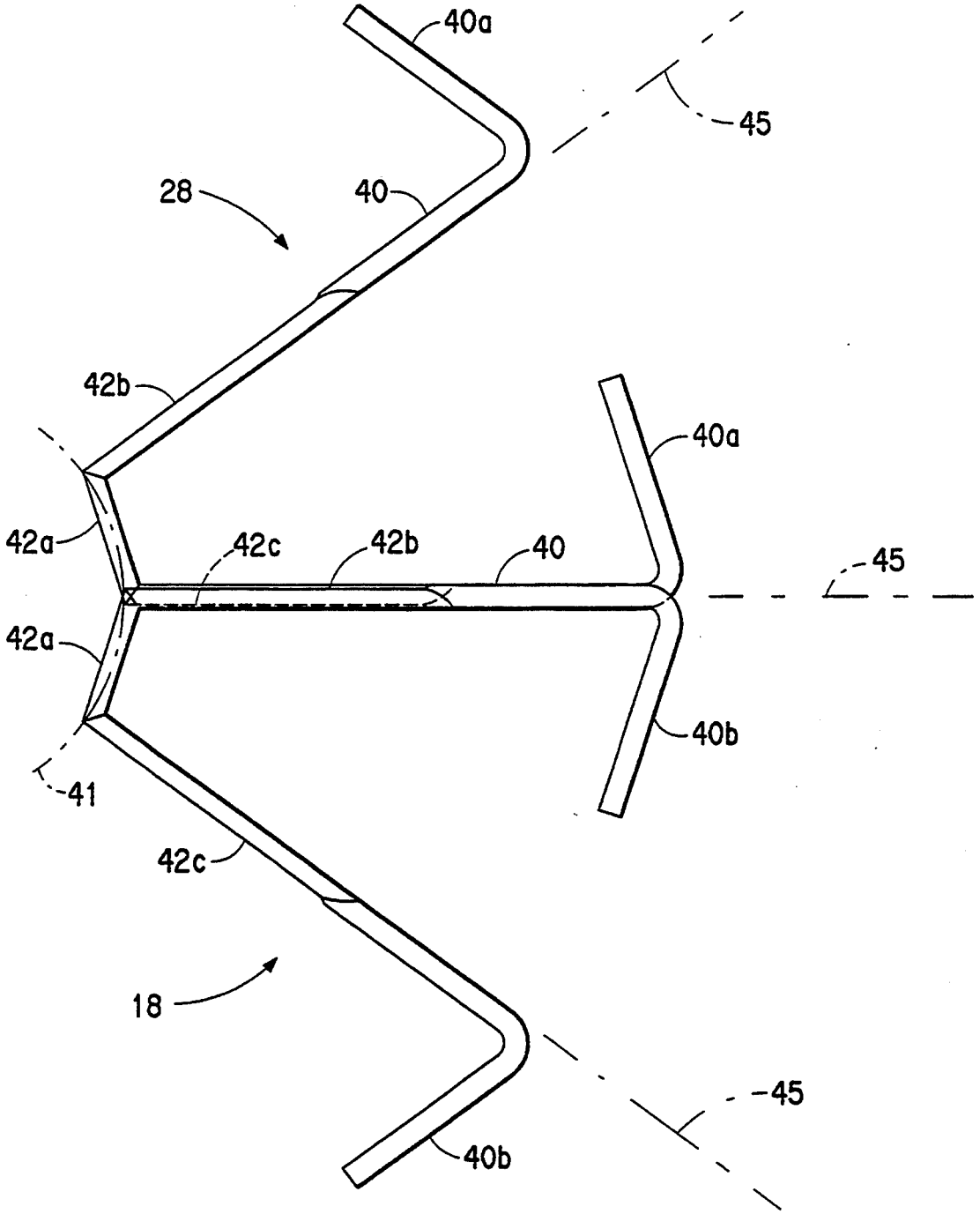
FIG. 11 is an enlarged, detailed view of one first and one second blade of FIG. 8 which share a common mounting slot, showing the relative positions of the cutting edges of the blades.
Figure 12A:
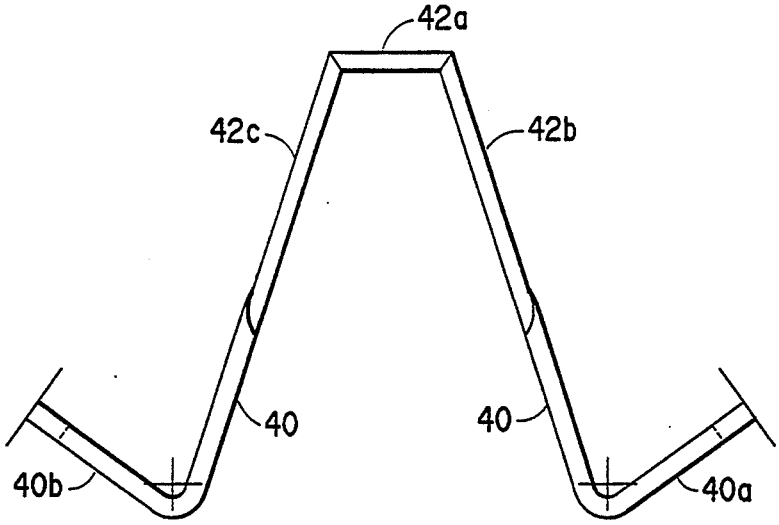
FIG. 12A is a plan view of a blade of the cutter blade assembly of the present invention.
Figure 12B:
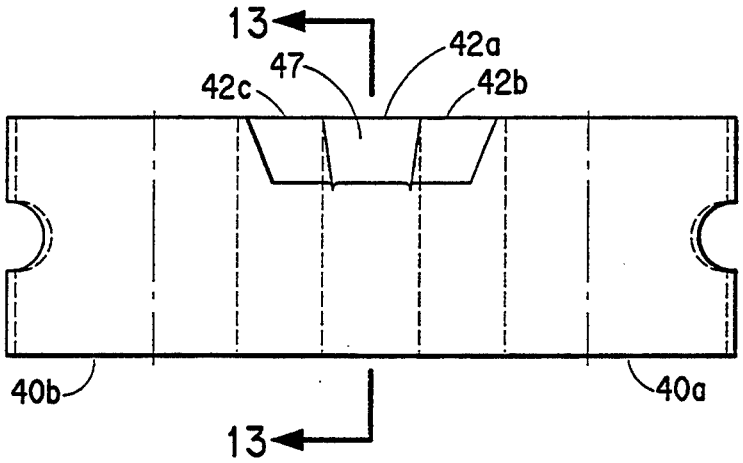
FIG. 12B is an elevational view of a blade of the cutter blade assembly of the present invention.
Figure 13:
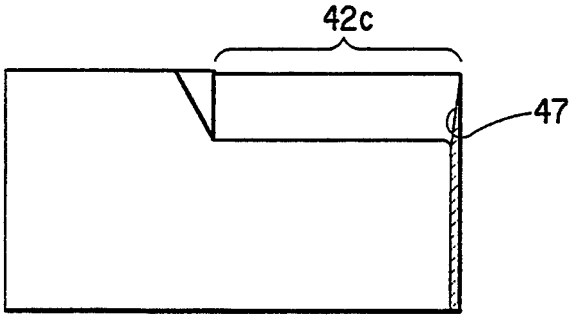
FIG. 13 is a cross-sectional view, taken along lines 13—13 of FIG. 12B, of the blade of the cutter blade assembly of the present invention.

As best seen in FIGS. 10, 12A and 12B, each of the first and second blades has a mounting portion 40 and a cutting portion, shown generally at 42. For the sake of simplicity, the mounting portion and the cutting portion are only illustrated for only one first blade 18 and second blade 28 in FIG. 11, it being understood that the other blades have the same configuration. Mounting portion 40 comprises a mounting tab 40*a* and a mounting tab 40*b* at the longitudinal ends of the blades, which are disposed in a respective mounting slot 38, and cutting portion 42 extends radially inwardly from the mounting portion. As can be seen from FIGS. 1–3, mounting portion 40 is fastened, typically by a machine screw 43, to the outer surface of the blade holder. An alternate fastener, such as a clamp (not shown), may be employed to rigidly hold the blades in place in the blade holder.

As shown in particular in FIGS. 10–12, cutting portion 42 comprises a center section 42*a* and two side sections 42*b* and 42*c*, respectively, intersecting the center section. Cutting portion 42 is shaped such that each section 42*a–c* conforms to three sides of an isosceles trapezoid. The center section conforms to the smaller base and each side section conforms to the two adjacent sides of the trapezoid. With the blade design of the present invention, only the center section of each second blade 28 cuts the product to form the second group of finished end products. This is preferable because the side sections have already been cut by the first blades, and the second blades are necessary only for cutting splines 26*a* from central portion 26. Center section 42*a* is tangent to an inscribed circle 41 as shown in FIG. 11 centered on the axis of longitudinal passage 16. Although center section 42*a* is shown as being straight, it may be curved and still remain tangent to the inscribed circle. Side sections 42*b* and 42*c*, corresponding to the lateral sides of the trapezoid, are non-parallel to each other and extend to mounting portion 40 from a respective end of the center section along a line 45 as shown in FIG. 11 radial to the axis of longitudinal passageway 16. The three sections of the cutting portion of the blade, i.e., the three sides of the isosceles trapezoid, define three sides of the peripheral segment. The inner wall of the blade holder defines the fourth side of the peripheral segment, which has a cross-sectional area having a shape which may be thus described as a sector of an annulus. With the group of blades as shown in FIGS. 5 and 7, and particularly in FIG. 8, an annulus is defined on the outside by the shape of the longitudinal passageway and on the inside by a ten-sided polygon formed by center sections 42*a* of the cutting portion of each blade. Side sections 42*b* and 42*c* divide this annulus into sectors.

As shown in FIGS. 10–13, cutting portion 42 has an inner face and an outer face. Specifically, the outer faces are ground back starting at the junction of mounting portions 40*a* and 40*b* and cutting portion 42 as shown in FIG. 11. The dashed line in FIG. 11 represents the ground back portion of lower, second blade 28. The outer faces are ground back by precision grinding by about one-third the thickness of each of the first and second blades to form a sharp corner at the intersection of center section 42*a* and each side section 42*b* and 42*c*, thereby eliminating the outer bend radius at each corner. If the outer face of the center section were not ground back, more material would have to be ground from the side sections to obtain the desired sharp corner. This would result in a weaker blade. FIG. 12A is a plan view of a blade of the present invention, and FIG. 12B is an elevational view of the blade in FIG. 12A, illustrating how the cutting portion of the blade is ground back. As shown in particular in FIG. 13, the inner face is ground back at an acute angle at 47 to form a cutting edge on center section 42*a* and side sections 42*b* and 42*c* at one longitudinal end of each of the first and second blades. Conventional sharpening techniques are used to achieve the required sharpness after the outer and inner faces are ground back.

The design of the blades achieves two purposes, namely, proper location of the two lateral cutting edges, relative to the line radial to the axis of longitudinal passage 16, and formation of sharp outer corners where the cutting edges intersect. As noted above, both the first and second blade groups are mounted in common mounting slots in the blade holder. Accordingly, precise lateral location of the cutting edges of the first blades relative to the second blades is achieved, which avoids cutting thin slivers when splined central portion 26 of the product passes through the second set of blades. In addition, the center section of the cutting edges of the first and second blades overlap slightly. The overlap of these cutting edges, combined with the sharp outer corners on the blades, ensures that no feathered edges are produced on the remaining central portion. For a typical blade, made from nominally 0.85 millimeter (0.035 inch) thick strip material, the lateral cutting edges typically overlap between 0.23 millimeters (0.009 inches) and 0.43 millimeters (0.017 inches), and the corners typically have a maximum radius of 0.25 millimeters (0.010 inches). Since the cutting edges of the first and second blades overlap slightly, the first peripheral segments, which are cut by the first blades, are ever so slightly larger than the second peripheral segments, which are cut by the second blades. Thus, the finished end products of the first group are slightly larger than the finished end products of the second group. Thus, as can be appreciated by one skilled in the art, if it is desired to cut finished end products from each blade group which are identical in size, the blades of the second blade group must be different in size than the blades of the first blade group.

The cutting edge on each side section of the first blades is radially offset with respect to the cutting edge on each side section of the second blades as shown in FIG. 11. As can be seen from FIG. 11, the cutting edge on each side section 42*b*, 42*c* is offset by about one-sixth of the thickness of each of the first and second blades from line 45 when each mounting section 40 is disposed in mounting slots 38. This prevents feathering on remaining central portion 26 as discussed above.

Figure 1:
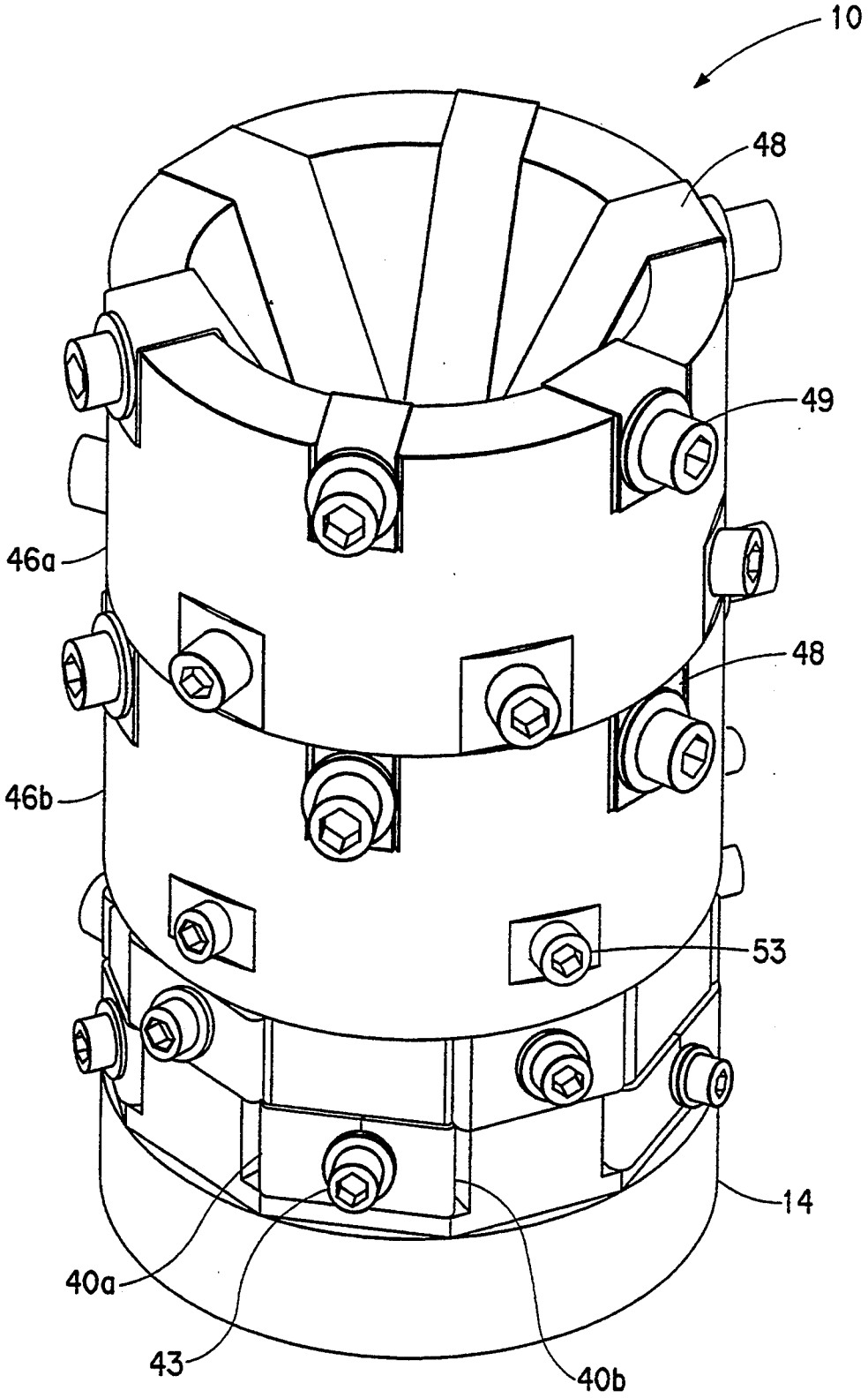
FIG. 1 is a perspective view of a cutter blade assembly according to a first embodiment of the present invention.

The cutter blade assembly of the present invention may further comprise a centering device 44 as shown in FIGS. 1 and 2 for centering the product as the product enters the first blade group. Centering device 44 is disposed in axial alignment with blade holder 14. As shown in FIGS. 1 and 2, centering device 44 comprises an elongated housing comprising a housing portion 46*a* and a housing portion 46*b*. Centering device 44 also comprises a group of leaf springs 48 mounted to the inner peripheral wall of each housing portion 46*a* and 46*b*. The leaf springs in housing portion 46*a* stabilize the product laterally as it is advanced through the centering device, and the leaf springs in housing portion 46*b* serve to further align the product axially with respect to the axis of the longitudinal passage as it is advanced to the first blade group. Leaf springs 48 are typically fastened to housing portions 46*a* and 46*b* by conventional fastening means, such as machine screws 49. Housing portions 46*a* and 46*b* are typically held together by machine screws 51, and blade holder 14 and housing portion 46*b* are fastened together by machine screws 53 as shown in FIGS. 1 and 3. Each of the machine screws engages a threaded hole 55. As best seen in FIG. 3, hole 55 receives screw 43.

Figure 15:
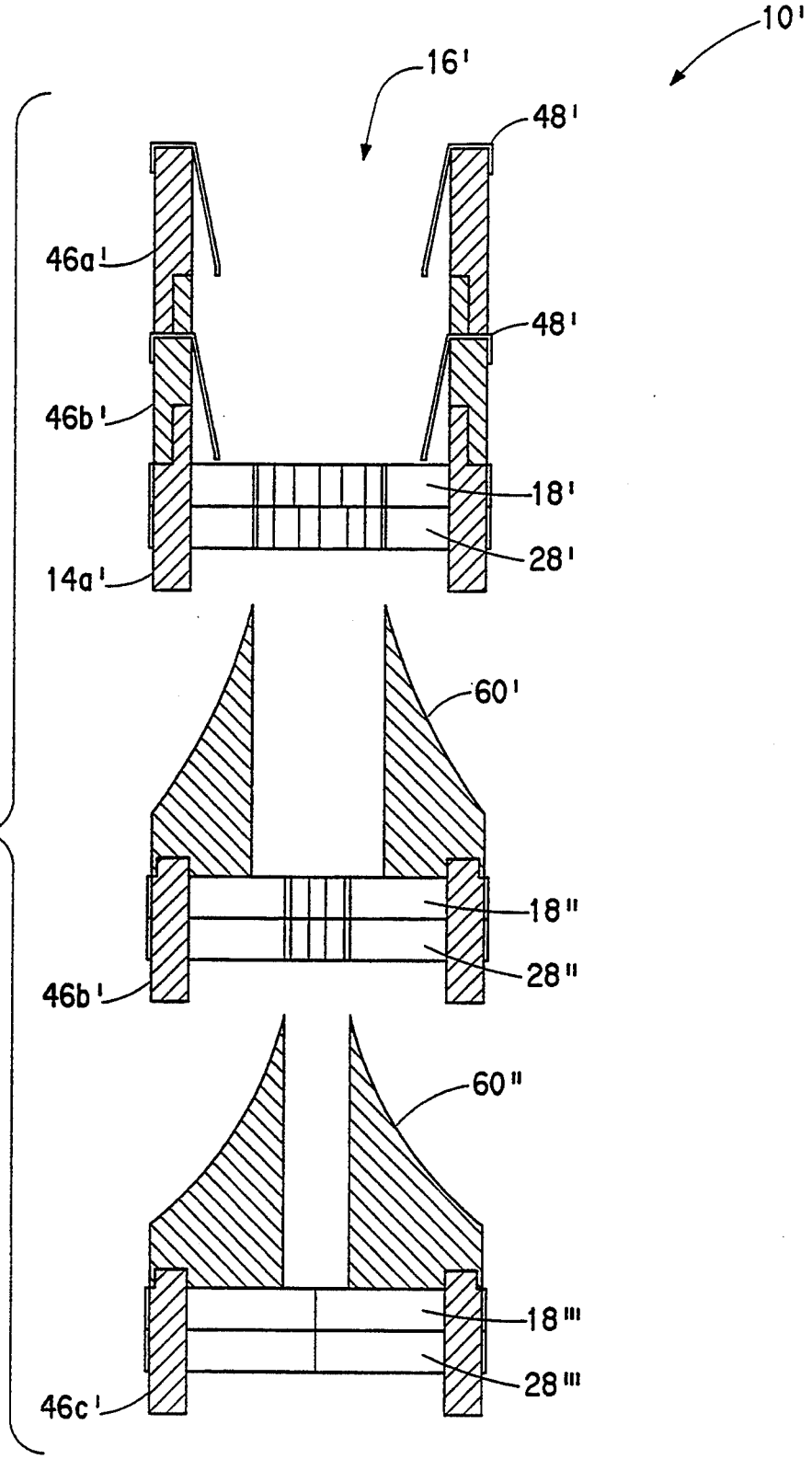
FIG. 15 is a sectional view of a cutter blade assembly according to a second method of the second embodiment of the present invention.
Figure 16A:
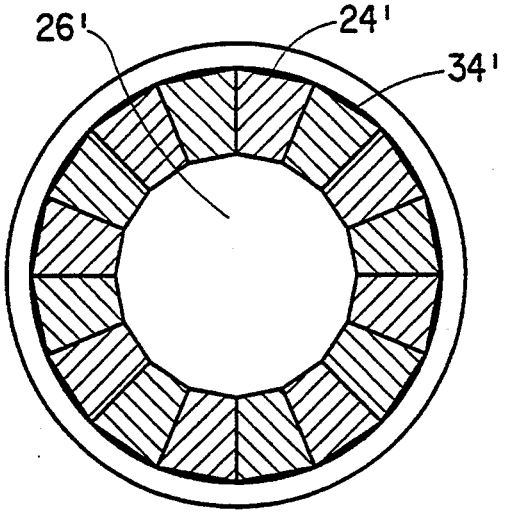
FIG. 16A is a plan view of the cutting pattern produced by the cut of the first blade set of the cutter blade assembly of FIG. 15.
Figure 16B:
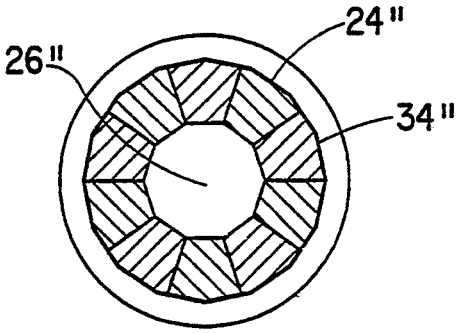
FIG. 16B is a plan view of the cutting pattern produced by the cut of the first successive blade set of the cutter blade assembly FIG. 15.
Figure 16C:
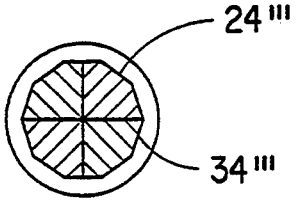
FIG. 16C is a plan view of the cutting pattern produced by the cut of the second successive blade set of the cutter blade assembly of FIG. 15.

Root crop vegetables, such as carrots, may be cut into sticks that are typically about 0.125–0.25 square inches (0.32–0.635 square centimeters) in cross-section. For carrots of about 1.25 inches (3.175 centimeters) in diameter, the cutter assembly of the first embodiment is particularly suitable for cutting a plurality of carrot sticks, e.g., ten sticks in the illustrated embodiment, leaving a central portion having a high fraction of core material. In accordance with a second embodiment of the present invention, for carrots of larger diameters, typically in the range of 2.00 inches (5.0 cm) to 2.50 inches (6.5 cm.), more than one layer of sticks could be cut from the outer periphery of the carrot cylinder before the core portion is encountered. Typically, the cutter blade assembly of the second embodiment is suitable for cutting carrot cylinders which have initial diameters in the range of 2.00 inches (5.0 centimeters) to 2.50 inches (6.5 centimeters). Several methods may be used to cut these successive layers. A first method is illustrated in the flow diagram of FIG. 14, and a second method is illustrated with reference to a cutter blade assembly as shown in FIG. 15 and a staged cutting pattern as shown in FIGS. 16A–16C.

Method 1

Figure 14:
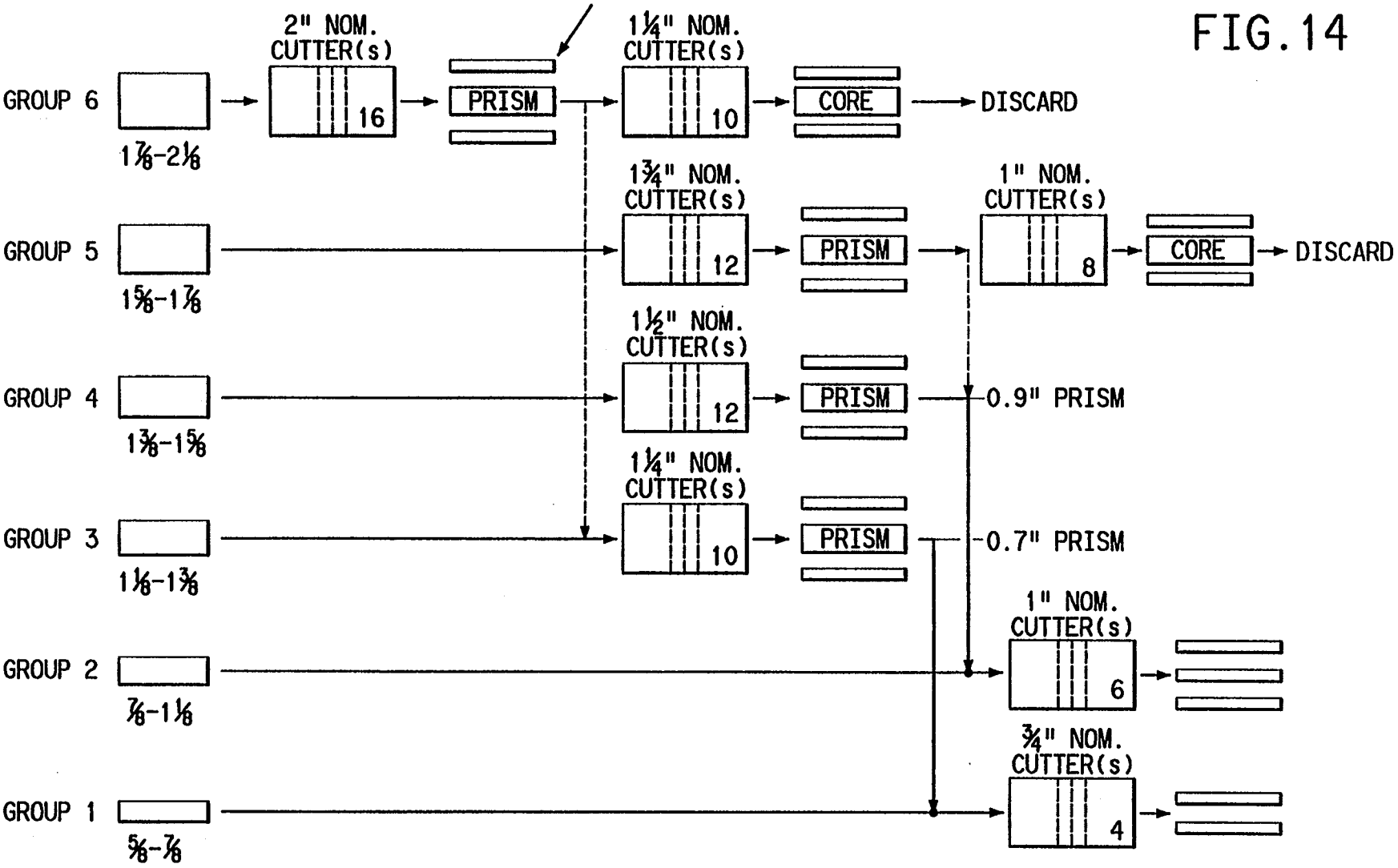
FIG. 14 is a flow diagram showing a cutting path according to a first method of a second embodiment of the present invention.

According to a first method of the second embodiment, illustrated in the flow diagram of FIG. 14, a series of cutter blade assemblies may be fabricated. Each cutter blade assembly is designed to cut a single outer layer of sticks from a given nominal diameter carrot cylinder. Each cutter blade assembly, utilizing the principles of the present invention, is of the appropriate diameter and has the appropriate number of blades to produce the desired size carrot sticks from the given diameter carrot cylinder.

In use, the carrot cylinders are sorted according to their diameter and routed to the appropriate cutter blade assembly. Large diameter carrot cylinders, after a single layer of carrot sticks has been cut therefrom, produce a remaining prism central portion that could have a further layer of sticks cut therefrom. This central portion is merged with incoming carrot cylinders of the same nominal diameter and routed to an appropriate sized cutter blade assembly for further cutting of carrot sticks, if desired. This process of size-sorting the remaining central portion for further cutting can be repeated until only the core portion of the carrot cylinder remains.

Method 2

According to a second method of the second embodiment as illustrated with respect to FIGS. 15 and 16A–16C, a staged cutter blade assembly may be fabricated. The staged cutter blade assembly comprises a plurality of successive blade sets, as described in detail below. A carrot stick diverter, as described in detail below, is positioned between each blade set to remove the already-cut carrot sticks and guide the remaining central portion, or prism, to the next successive blade set.

A cutter blade assembly according to the second embodiment is shown generally at 10' in FIG. 15. Cutter blade assembly 10' comprises an elongated blade holder comprising a plurality of portions 14a'–14c' as shown in FIG. 15. The blade holder has a longitudinal passage 16' formed therein as shown in FIG. 15.

The cutter blade assembly of the second embodiment of the present invention also comprises a first blade set. The first blade set comprises a first blade group 18' and a second blade group 28' as shown in FIG. 15. First blade group 18' includes a plurality of first blades which are radially disposed about the blade holder. Second blade group 28' includes a plurality of second blades which are also radially disposed about the blade holder, and which are angularly rotated with respect to the first blades. The second embodiment follows the principles of the first embodiment, differing primarily in the number of blades incorporated in each blade set. While the blade set 18, 28 of the first embodiment typically has ten blades, the first blade set of the second embodiment typically has 16 blades. Blades 18', 28' have the same general appearance as blades 18 and 28, respectively. However, the overall dimension and angle between the side sections of the cutting portion of blades 18' and 28' are different from those of blades 18 and 28.

The first blade set cuts a first group of sixteen finished end products, with first blade group 18' cutting finished end products 24' and second blade group 28' cutting finished end products 34'. Finished end products 24' cut by first blade group 18' are hatched in a right-hand direction as shown in FIG. 16A, and finished end products 34' cut by second blade group 28' are hatched in a left-hand direction as shown in FIG. 16A. Finished end products 24', 34' have a generally trapezoidal cross-sectional area, with one surface being curved corresponding to the outer surface of the finished product. After cutting away the first group of finished end products from the product, a sixteen-sided prism 26' remains as shown in FIG. 16A.

The cutter blade assembly of the second embodiment of the present invention comprises at least one successive set of first and second blade groups disposed in axial alignment with one of the first and second blade groups. For the illustrated embodiment, only two successive sets of blade groups are shown in FIG. 15. However, it should be understood that the cutter blade assembly of FIG. 15 may comprise even further blade sets, the number of blade sets being determined by the size and nature of the product being cut and the size, geometry and nature of the finished end products. The first of the two successive blade sets shown in FIG. 15 also comprises a first blade group 18'' and a second blade group 28''. First blade group 18'' includes a plurality of first blades which are radially disposed about the blade holder, and second blade group 28'' includes a plurality of second blades which are also radially disposed about the blade holder and angularly rotated with respect to the first blades. The arrangement and configuration of the blades in the second blade set is essentially the same as that of blades 18, 28 of the first embodiment. Moreover, the arrangement and configuration of the first and second blades in the first successive blade set are the same as in the first blade set, except that the number of first and second blades of the first successive blade set is smaller than the number of respective first and second blades of the first blade set. Also, the diameter of the product cut by the first blade set is larger than the diameter of the product cut by the first successive blade set.

The first successive blade set cuts a second group of ten finished end products, with first blade group 18'' cutting finished end products 24'' and second blade group 28'' cutting finished end products 34''. Finished end products 24'' cut by first blade group 18'' are hatched in a right-hand direction as shown in FIG. 16B, and finished end products 34'' cut by second blade group 28'' are hatched in a left-hand direction as shown in FIG. 16B. Finished end products 24'', 34'' have an irregular pentagonal cross-sectional area, with the outer two surfaces of each finished end product corresponding to portions of two of the surfaces of sixteen-sided prism 26' remaining after the product has been advanced through the first blade set. After cutting away the second group of finished end products, a ten-sided prism 26'' remains as shown in FIG. 16B.

The second of the two successive blade sets shown in FIG. 15 comprises also comprises a first blade group 18''' and a second blade group 28'''. First blade group 18''' includes a plurality of first blades which are radially disposed about the blade holder, and second blade group 28''' includes a plurality of second blades which are also radially disposed about the blade holder and angularly rotated with respect to the first blades. The arrangement and configuration of the first and second blades in the second successive blade set are the same as in the first successive blade set, except that the number of first and second blades of the second successive blade set is smaller than the number of respective first and second blades of the first successive blade set. Also, the diameter of the product cut by the first successive blade set is larger than the diameter of the product cut by the second successive blade set.

The second successive blade set cuts a second successive group of eight finished end products, with first blade group 18''' cutting finished end products 24''' and second blade group 28''' cutting finished end products 34'''. End products 24''' cut by first blade group 18''' are hatched in a right-hand direction as shown in FIG. 16C, and finished end products 34''' cut by second blade group 28''' are hatched in a left-hand direction as shown in FIG. 16C. Finished end products 24''', 34''' also have an irregular pentagonal cross-sectional area, with the outer two surfaces of each finished end product corresponding to portions of two of the surfaces of ten-sided prism 26'' remaining after the product has been advanced through the first successive blade set. After cutting away the final group of finished end products, an eight-sided prism 26''' remains as shown in FIG. 16C. In a preferred embodiment, when the product cut by the cutter blade assembly of the second embodiment is a carrot cylinder, eight-sided prism 26''' is typically comprised entirely of core material. Even though this eight-sided prism is approximately the same overall size as the previously cut carrot sticks, it is considered commercially unacceptable and is separated from the commercially acceptable carrot sticks. However, depending on the product cut, the prism may be cut again by a successive blade set.

The cutter blade assembly according to the second embodiment of the present invention also comprises a centering device for each blade set. In cutter blade assembly 10' as shown in FIG. 15, a centering device for the first blade set comprises a first housing portion 46a' and a second housing portion 46b'. As in the first embodiment, the centering device for the first blade set also comprises a plurality of leaf springs 48' mounted to the inner peripheral wall of housing portions 46a', 46b'. The leaf springs in housing portion 46a' stabilize the product laterally as it is advanced through the centering device, and the leaf springs in housing portion 46b' serve to further align the product axially with respect to the axis of longitudinal passage 16' as it is advanced to the first blade group.

Cutter blade assembly 10' also comprises a first diverter assembly disposed in axial alignment with first blade set 18', 28' and a second diverter assembly disposed in axial alignment with second blade set 18'', 28''. A first diverting mechanism comprising, for example, a hyperboloid-shaped product diverter 60' as shown in FIG. 15, or alternatively, a plurality of leaf springs, is disposed in the first diverter assembly for diverting the first group of finished end products 24', 34' out of the first blade set and causes only remaining central prism 26' to pass to the next blade set, and a second diverter 60'' is similarly disposed in the second diverter assembly for the same purpose of diverting the second group of finished end products 24'', 34'' out of the first successive blade set.

As noted above, the cutter blade assembly of the second embodiment cuts sixteen finished end products with the first blade set, ten with the second blade set, and four with the third blade set. These numbers of end products are exemplary only, with the number of end products cut by each blade set depending on the size of the original, uncut product and the desired size of the finished end products. Typically, the first blade set in the cutter blade assembly of the second embodiment is sized to receive a nominal 2.25-inch (5.72 centimeters) diameter carrot cylinder, and the first successive blade set is sized to receive a nominal 1.25-inch (3.18 centimeters) diameter prism emerging from the first blade set. The next successive blade set is sized to receive a nominal 0.75-inch (1.90 centimeters.) diameter prism emerging from the first successive blade set. Also, the shape of the finished end products of FIGS. 16A–16C are exemplary for this particular embodiment. The finished end products shown in FIGS. 16A–16C may take on a variety of cross-sectional shapes, depending on the relative number of finished end products cut at each stage. Such finished end products might typically be in the shape of a triangle, a trapezoid, or an irregular polygon, such as a pentagon or a hexagon.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A cutter blade assembly for cutting a product into a plurality of finished end products, comprising:

(a) an elongated blade holder having a longitudinal passage and a plurality of mounting slots formed therein;

(b) a first blade group including a plurality of first blades radially disposed about the blade holder and mounted in the mounting slots; and (c) a second blade group including a plurality of second blades radially disposed about the blade holder and mounted in the mounting slots, each second blade being angularly displaced from a corresponding first blade, the mounting slots being common to both the first and the second blades, the first blades cutting a first group of finished end products from the product as the product is advanced through the longitudinal passage and the second blades cutting a second group of finished end products from the product as the product is further advanced through the longitudinal passage.

2. The cutter blade assembly of claim 1, wherein the first blades and the longitudinal passage form a plurality of first peripheral segments and the second blades and the longitudinal passage form a plurality of second peripheral segments.

3. The cutter blade assembly of claim 2, wherein each of the first and second peripheral segments are substantially identical to each other and have a cross-sectional shape of a sector of an annulus.

4. The cutter blade assembly of claim 2, further including a first space formed between each respective adjacent first peripheral segment and a second space formed between each respective adjacent second peripheral segment, wherein each first space is aligned with a respective second peripheral segment and each first peripheral segment is aligned with a respective second space.

5. The cutter blade assembly of claim 1, wherein the number of common mounting slots is an even integer equal to at least four.

6. The cutter blade assembly of claim 1, wherein each of the first and second blades is adapted to be inverted in a respective common mounting slot.

7. The cutter blade assembly of claim 1, wherein the first and second blades are interchangeable with each other.

8. The cutter blade assembly of claim 1, wherein each of the first and second blades has a mounting portion and a cutting portion, the mounting portion being disposed in a respective mounting slot and the cutting portion extending radially inwardly from the mounting portion.

9. The cutter blade assembly of claim 8, wherein the cutting portion comprises a center section and two side sections each intersecting the center section, the center section being tangent to an inscribed circle centered on the axis of the longitudinal passage, and the two side sections being non-parallel to each other and each extending from a respective end of the center section along a respective line radial to the mounting portion.

10. The cutter blade assembly of claim 9, wherein the cutting edge on each side section of the first blades is radially offset with respect to the cutting edge on each respective, corresponding side section of the second blades to prevent formation of feathered edges on a central portion remaining after the first blades cut the first group of finished end products.

11. The cutter blade assembly of claim 9, wherein the cutting portion has an inner face and an outer face, and further wherein the outer face is ground back by about one-third the thickness of each of the first and second blades to form a sharp corner at the intersection of the center section and each side section, and the inner face of the cutting portion is ground back at an acute angle to form a cutting edge on the cutting section and the side sections at one longitudinal end of each of the first and second blades.

12. The cutter blade assembly of claim 11, wherein the cutting edge on each side section is offset by about one-sixth of the thickness of each of the first and second blades, respectively, from a line radial to the axis of the longitudinal passage when the mounting portions are disposed in the mounting slots.

13. The cutter blade assembly of claim 9, wherein only the center section of each second blade cuts the product to form the second group of finished end products.

14. The cutter blade assembly of claim 1, further including a centering device disposed in axial alignment with the blade holder for centering the product as the product enters the first blade group, the centering device comprising an elongated housing and a plurality of leaf springs mounted to an inner peripheral wall of the housing.

15. The cutter blade assembly of claim 1, further comprising at least one successive set of first and second blade groups disposed in axial alignment with one of the first and second blade groups for cutting a respective successive group of finished end products.

16. The cutter blade assembly of claim 15, wherein the successive set of first and second blade groups has a successively smaller diameter and a fewer number of blades than the preceding set of blade groups.

17. A cutter blade assembly for cutting a generally cylindrically shaped food product into a plurality of end products, comprising:

(a) a blade-holder having a generally cylindrical area and a longitudinal passage formed therein;

(b) a plurality of blade-holding slots formed in the outer periphery of the blade-holder;

(c) a first blade group comprising a plurality of first blades radially disposed about the longitudinal passage in the blade-holding slots, the first blades and the longitudinal passage defining a plurality of respective first peripheral segments, each having a cross-sectional area having a shape of a sector of an annulus, the first blades cutting a plurality of radially spaced portions from the periphery of the generally cylindrical product to form a first group of products having a cross-sectional area having a shape of a sector of an annulus and a prism-shaped first central portion comprising a plurality of splines;

(d) a second blade group comprising a plurality of second blades radially disposed about the longitudinal passage in the blade-holding slots, each second blade being angularly displaced from a corresponding first blade, the second blades and the longitudinal passage defining a plurality of respective second peripheral segments, each having a cross-sectional area having a shape of a sector of an annulus, the second blades cutting the splines from the central portion to form a second group of products having a cross-sectional area having a shape of a sector of an annulus and a prism-shaped second central portion; and (e) a centering device for centering the generally cylindrical product as the product is advanced to the first blade group, the centering device including:

(i) an elongated housing having a generally cylindrical area and a longitudinal passage formed therein, and (ii) a plurality of leaf springs radially disposed about an inner peripheral wall of the elongated housing.

18. A cutter blade assembly for cutting a product into a plurality of finished end products, comprising:

(a) an elongated blade holder having a longitudinal passage and a plurality of mounting slots formed therein;

(b) a first blade group including a plurality of first blades radially disposed about the blade holder and mounted in the mounting slots; and (c) a second blade group including a plurality of second blades radially disposed about the blade holder and mounted in the mounting slots, each second blade being angularly displaced from a corresponding first blade, the mounting slots being common to both the first and the second blades, wherein the product has a generally cylindrical shape and the first blades cut a plurality of radially spaced portions from the periphery of the product to form a first group of finished end products and a central portion comprising a plurality of splines as the product is advanced through the longitudinal passage and the second blades subsequently cut the splines from the central portion to form a second group of finished end products as the product is further advanced through the longitudinal passage, leaving a prism-shaped central portion.

19. The cutter blade assembly of claim 18, wherein each finished end product has a generally trapezoidal cross-sectional area.

* * * * *